US007934964B2

(12) United States Patent
Fukuoka

(10) Patent No.: US 7,934,964 B2
(45) Date of Patent: May 3, 2011

(54) OUTBOARD MOTOR

(75) Inventor: Yoshihito Fukuoka, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 0 days.

(21) Appl. No.: 12/340,822

(22) Filed: Dec. 22, 2008

(65) Prior Publication Data

US 2009/0170386 A1 Jul. 2, 2009

(30) Foreign Application Priority Data

Dec. 28, 2007 (JP) ..... 2007-340004

(51) Int. Cl.
*B63H 20/32* (2006.01)

(52) U.S. Cl. ..... 440/76; 440/83

(58) Field of Classification Search ..... 440/76, 440/77, 83

See application file for complete search history.

(56) References Cited

U.S. PATENT DOCUMENTS 4,747,795 A * 5/1988 Kawamura et al. ..... 440/76
6,146,222 A * 11/2000 Murata et al. ..... 440/83
7,244,152 B1 7/2007 Uppgard
7,494,392 B1 * 2/2009 Latham ..... 440/83
7,503,817 B2 * 3/2009 Ide et al. ..... 440/76
2008/0070739 A1 3/2008 Nakamura et al.
2008/0233815 A1 9/2008 Nakamura et al.

FOREIGN PATENT DOCUMENTS

EP 1 122 411 A 8/2001
WO 2007/007707 A1 1/2007

OTHER PUBLICATIONS

Fukuoka; "Outboard Motor": U.S. Appl. No. 12/340,819; filed Dec. 22, 2008.

Official Communication issued in European Search Report No. EP 08 02 2400, search completed on Jun. 8, 2009.

* cited by examiner

*Primary Examiner* — Lars A Olson

(74) *Attorney, Agent, or Firm* — Keating & Bennett, LLP

(57) ABSTRACT

In an outboard motor, a lower casing is located below an upper casing, and an engine with a vertically-arranged crankshaft is mounted above the upper casing. The rotation of the crankshaft is transmitted to a drive shaft pivotally supported in the upper casing, has its speed changed by a transmission mounted on the drive shaft, and is transmitted to a propeller shaft pivotally supported in the lower casing. The upper casing includes an upper-side casing and a lower-side casing, and mating surface portions of the upper-side casing and the lower-side casing are laterally wider than an upper section and a lower section of the upper casing.

9 Claims, 6 Drawing Sheets

OUTBOARD MOTOR

BACKGROUND OF THE INVENTION

1. Field of the Invention

The present invention relates to an outboard motor having a mechanism arranged to transmit engine power to a propeller through a shaft, and especially relates to an outboard motor equipped with a transmission arranged to change the rotational speed of a shaft.

2. Description of the Related Art

Conventionally, in an outboard motor, engine power is transmitted to a crankshaft, a drive shaft, and a propeller shaft, and then is transmitted to a propeller from the propeller shaft. Conventionally, the engine power is transmitted as is to the propeller through each of the aforementioned shafts. Thus, when it is desired to change the speed of a watercraft, the engine power is adjusted to change the rotational speed of each shaft, so that the rotational speed of the propeller is changed subsequently to cause a change in the speed of the watercraft.

However, recent outboard motors have been provided with a transmission on a drive shaft and adapted to change the speed of a watercraft with the transmission rather than relying exclusively on the engine power (see WO 2007/007707, for example).

It often happens that the upper casing in which the drive shaft is inserted does not have enough width to allow for the insertion of the transmission. Thus, when the transmission is mounted on the drive shaft, a wide upper casing is utilized so that the drive shaft and the transmission can be inserted therein. In addition, with modifications of the upper casing, other members such as a mounting plate attached above the upper casing and a lower casing attached below the upper casing need to be modified in accordance with the configuration of the upper casing. This causes a problem of increased cost.

Furthermore, when the lateral width is widened from a lower section of the upper casing through the lower casing for the insertion of the transmission in the upper casing, there arises a problem of increased resistance to water.

SUMMARY OF THE INVENTION

In view of the foregoing circumstances, preferred embodiments of the present invention provide an outboard motor in which configurations of connection portions of an upper casing with other members remain unchanged from those before a transmission is provided in the upper casing and in which the same members as those before the installation of the transmission can be used except for the upper casing, so that it is possible to minimize the cost related to the installation of the transmission and to prevent an increase in resistance to water.

According to a preferred embodiment of the present invention, an outboard motor includes a lower casing located below an upper casing, and an engine with a vertically-arranged crankshaft mounted above the upper casing. The rotation of the crankshaft is transmitted to a drive shaft pivotally supported in the upper casing, has its rotational speed changed by a transmission mounted on the drive shaft, and the rotational force produced thereby is transmitted to a propeller shaft pivotally supported in the lower casing. The upper casing preferably includes an upper-side casing and a lower-side casing. A mating surface between the upper-side casing and the lower-side casing is laterally wider than an upper section and a lower section of the upper casing.

In addition, an upper mount and a lower mount arranged to support the outboard motor to a hull are preferably included, and the upper mounts are provided as a right and left pair. The width between the upper mounts is narrower than the lateral width of the mating surface portion in the upper casing.

Furthermore, a divider is preferably arranged to divide the inside of the upper casing into a front chamber and a rear chamber, and the divider is preferably provided by joining a divider of the upper-side casing to a divider of the lower-side casing.

Moreover, a bolt seat for joining is preferably provided in the mating surface portion of the divider, and a joined surface of the divider is sealed.

The upper casing is preferably defined by the upper-side casing and the lower-side casing, and the mating surface between the upper-side casing and the lower-side casing is preferably laterally wider than the upper section and the lower section of the upper casing. Accordingly, the configuration of the upper casing can correspond to that of the transmission by widening only a portion in which the transmission is disposed while portions joined to other members such as the mounting plate and the lower casing remain unchanged. Therefore, various types of transmissions can be installed in the outboard motor without replacing members such as the mounting plate and the lower casing but by simply replacing the upper casing. Consequently, it is possible to greatly reduce and minimize the cost for installation of the transmission in the outboard motor.

In addition, since there is no need to extend a lateral width from the lower section of the upper casing through the lower casing, it is possible to prevent an increase in resistance to water.

The width between the upper mounts, which are provided as a right and left pair to mount the outboard motor to a hull, preferably is narrower than the lateral width of the mating surface portion in the upper casing. Therefore, it is possible to damp and prevent vibration of the hull by absorbing rotational vibrations of the outboard motor.

A divider arranged to divide the inside of the upper casing into a front chamber and a rear chamber is preferably provided by joining a divider of an upper-side casing and a divider of a lower-side casing, and the transmission is disposed in the front chamber. Thus, the transmission can easily be located in a desired position in the upper casing and can be prevented from being influenced or affected by components disposed in the rear chamber (heat, oil content, and moisture, for example).

A bolt seat for joining is preferably provided in the mating surface portion of the divider, and the mating surface of the divider is sealed. Thus, an upper-side and a lower-side divider can be rigidly joined together by bolting the mating surfaces of the dividers. It is also possible to completely separate the front chamber, which contains the transmission therein, from the rear chamber in which an exhaust pipe and the like are disposed. Accordingly, the transmission can further be prevented from being influenced or affected by the components disposed in the rear chamber (heat, oil content, and moisture, for example).

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

Description will hereinafter be made of preferred embodiments of the present invention.

Figure 1:
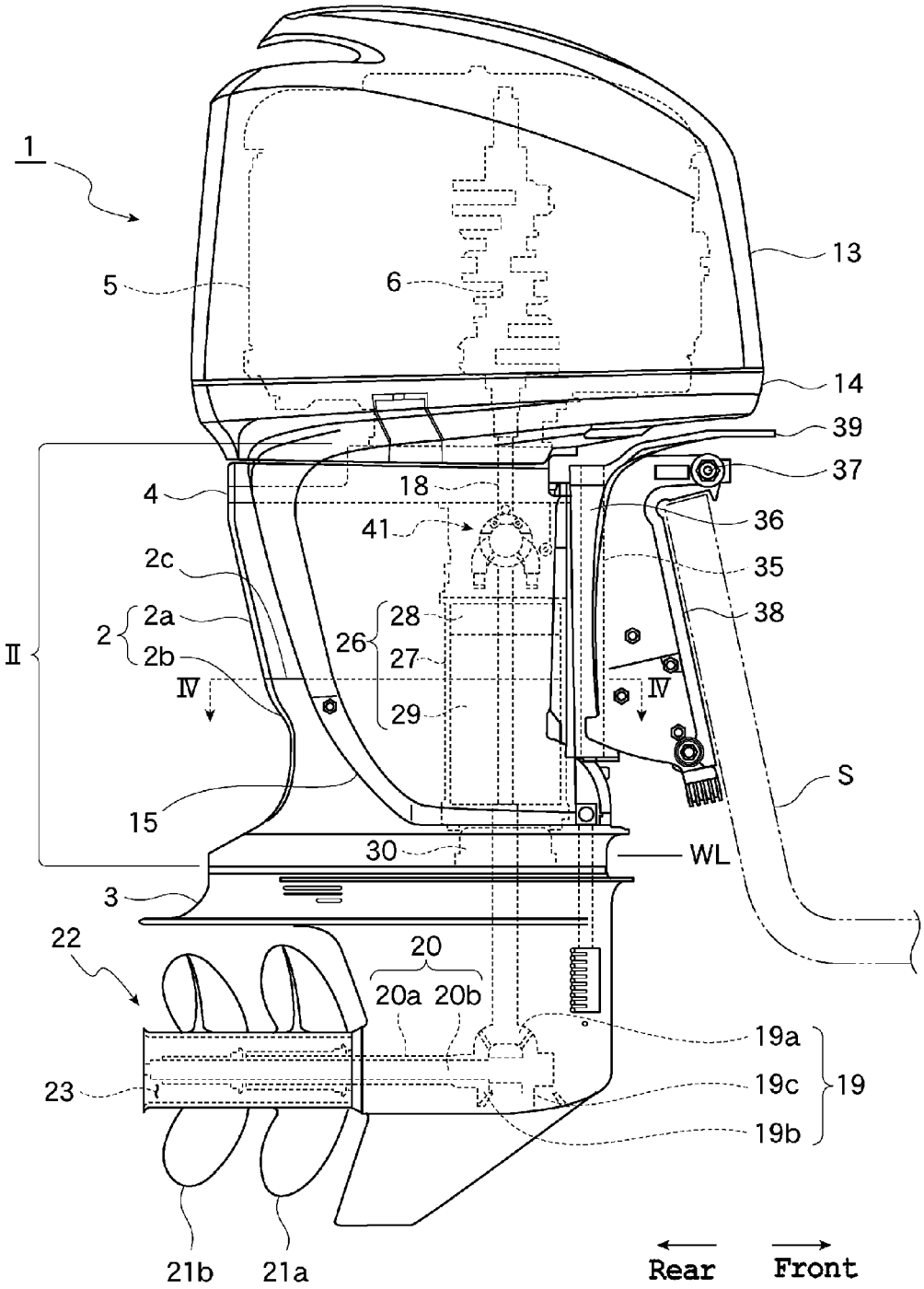
FIG. 1 is a right side view showing an outboard motor according to a preferred embodiment of the present invention.
Figure 2:
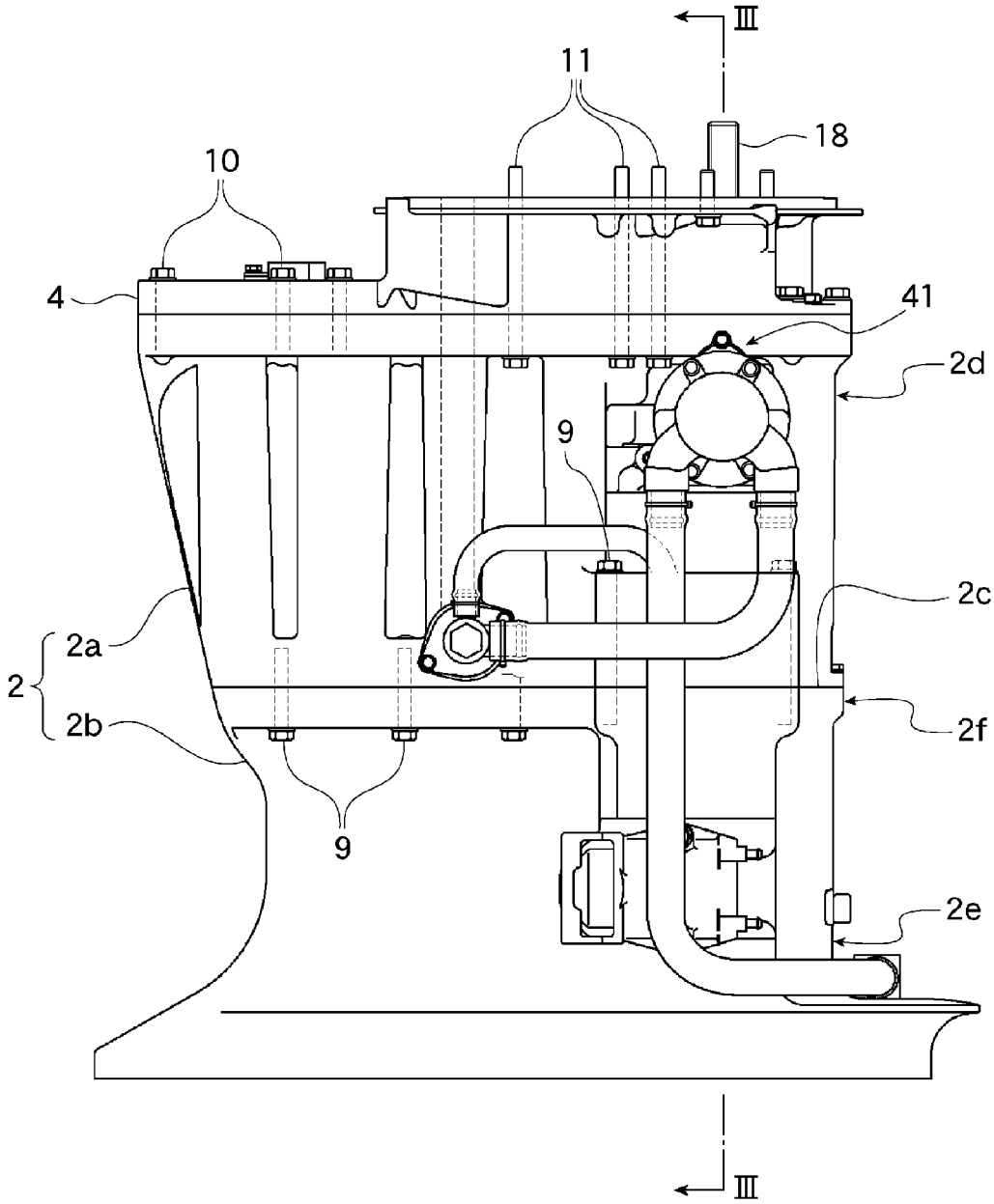
FIG. 2 is an enlarged view of a section II in FIG. 1 according to a preferred embodiment of the present invention.
Figure 3:
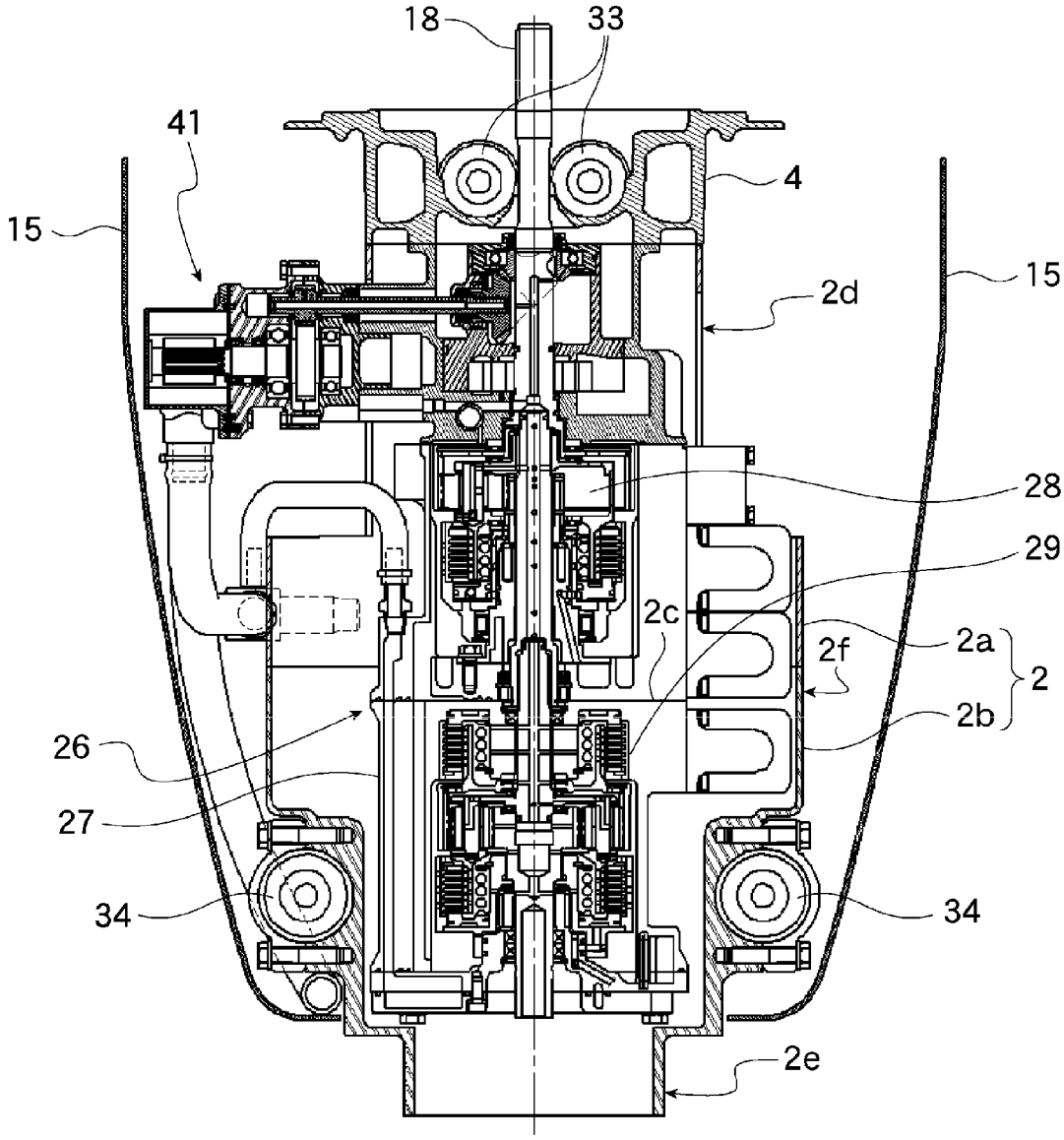
FIG. 3 is a vertical sectional view taken along the line III-III in FIG. 2 according to a preferred embodiment of the present invention.
Figure 4:
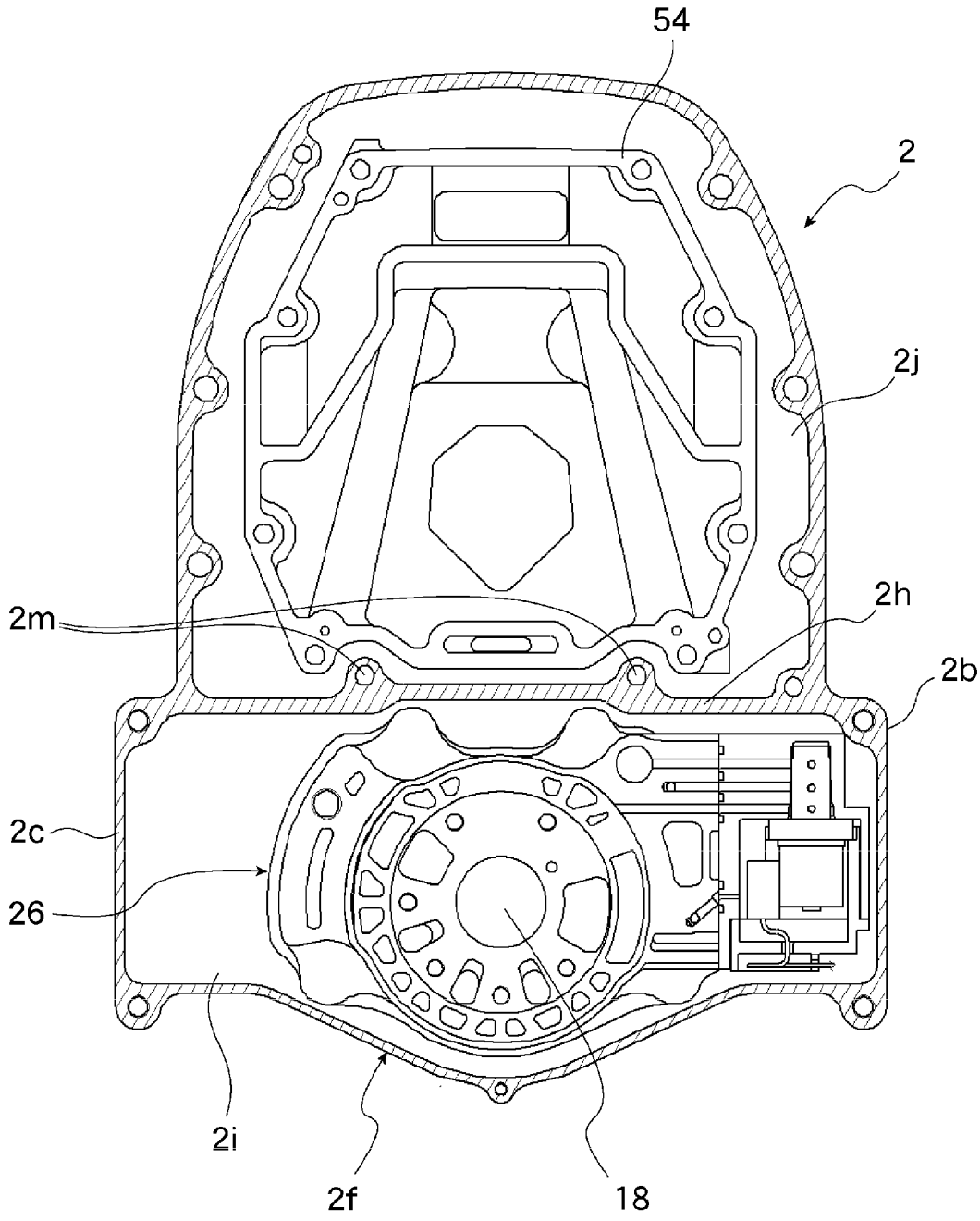
FIG. 4 is a cross-sectional view taken along the line IV-IV in FIG. 1 according to a preferred embodiment of the present invention.
Figure 5:
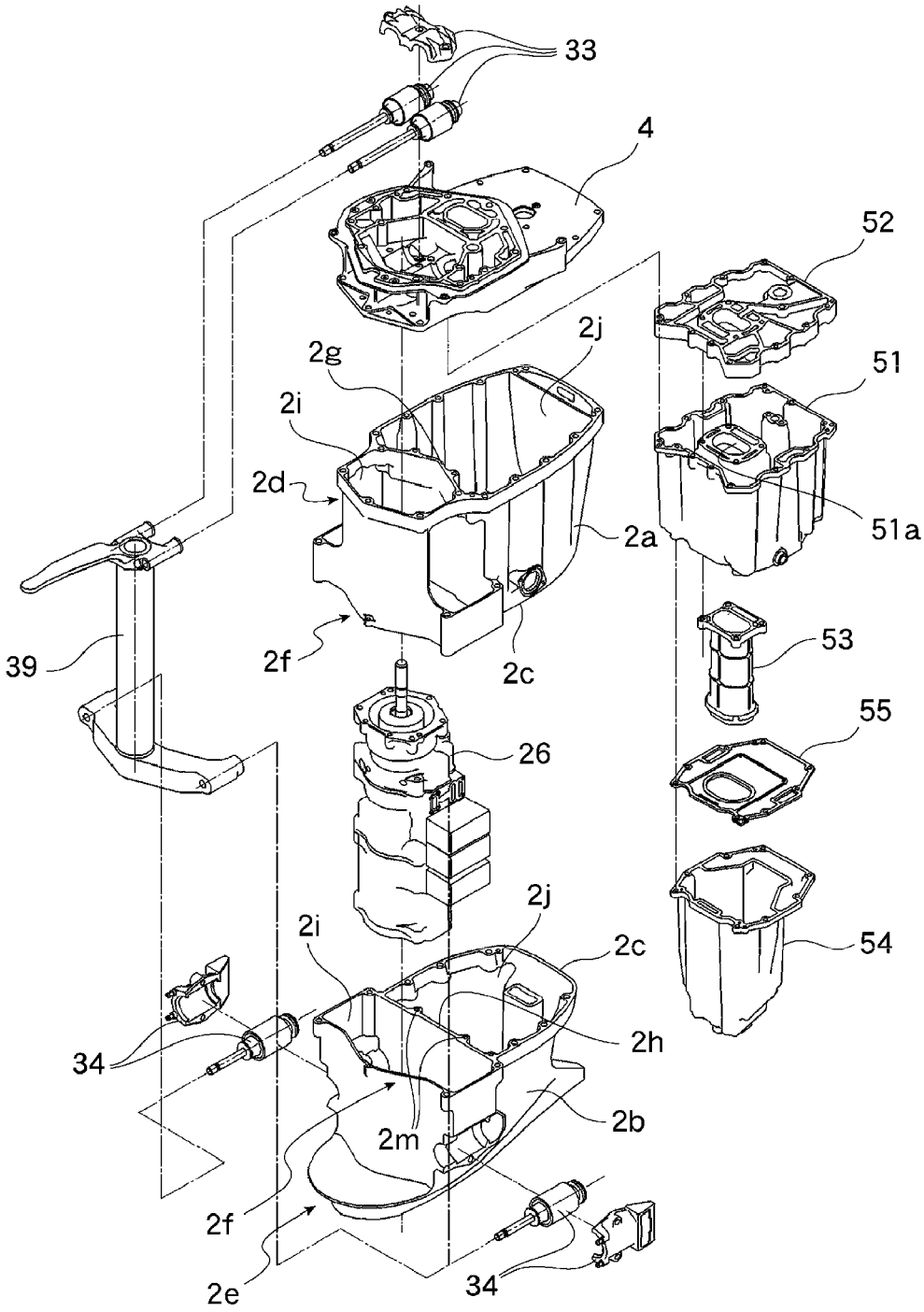
FIG. 5 is an exploded perspective view of an upper casing and its surrounding members of the outboard motor according to a preferred embodiment of the present invention.
Figure 6:
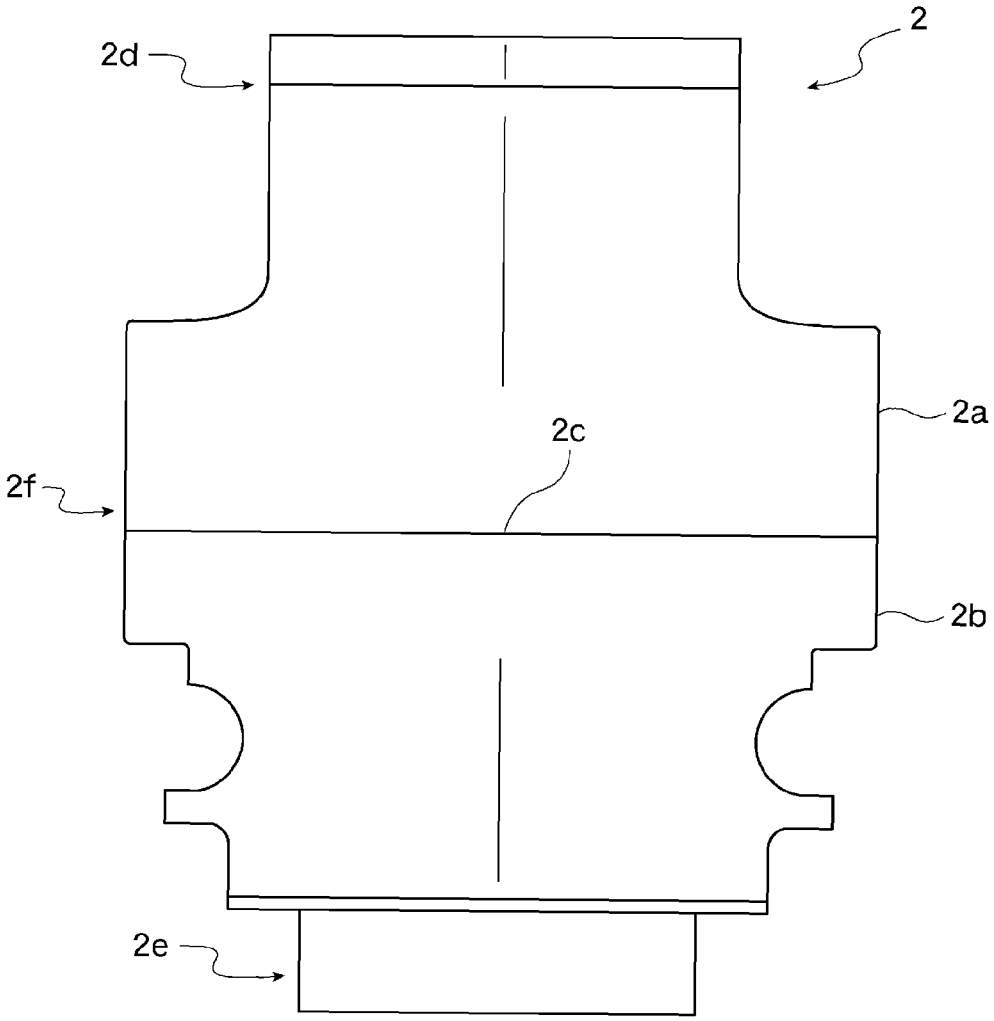
FIG. 6 is a front view showing the upper casing according to a preferred embodiment of the present invention.

FIG. 1 is a right side view showing an outboard motor according to a preferred embodiment of the present invention. FIG. 2 is an enlarged view of a section II of FIG. 1 according to a preferred embodiment of the present invention. FIG. 3 is a longitudinal sectional view taken along the line III-III in FIG. 2 according to a preferred embodiment of the present invention. FIG. 4 is a transverse sectional view taken along the line IV-IV in FIG. 1 according to a preferred embodiment of the present invention. FIG. 5 is an exploded perspective view showing an upper casing and its surrounding members of the outboard motor according to a preferred embodiment of the present invention. FIG. 6 is a front view showing the upper casing of the outboard motor according to a preferred embodiment of the present invention. Here, FIG. 2 shows a state that a side cover 15, which will be described below, is removed.

As shown in FIG. 1, in an outboard motor 1 of this preferred embodiment, a lower casing 3 is provided below an upper casing 2, and an engine 5 is mounted above the upper casing 2 via a generally flat mounting plate 4. The engine 5 preferably is, for example, a water-cooled V6 engine and is mounted on the mounting plate 4 such that a crankshaft 6 thereof is in a vertical position.

The engine 5 is covered by a detachable upper cover 13 and a detachable lower cover 14. As shown in FIG. 3, a right side surface and a left side surface of the upper casing 2 are covered by a side cover 15, which is also detachable.

As shown in FIGS. 4 and 5, the upper casing 2 is divided by dividers 2*g*, 2*h* into a front chamber and a rear chamber (the front and rear in a traveling direction of a watercraft indicated by the arrow in FIG. 1). A front chamber 2*i* (forward chamber) is a space in which a drive shaft 18, a transmission 26, and other suitable elements are disposed. Meanwhile, a rear chamber 2*j* (rearward chamber) is a space to dispose therein an oil pan 51 for holding lubricating oil, an oil pan cover 52 to cover the oil pan 51, an exhaust pipe 53 that is arranged to communicate with an exhaust hole 51*a* formed in the oil pan 51 and that allows exhaust gases discharged from the engine to pass through, an exhaust expansion chamber 54 arranged to expand the exhaust gases passed through the exhaust pipe 53, an exhaust chamber cover 55 disposed between the exhaust expansion chamber 54 and the exhaust pipe 53, and other suitable elements. The engine is lubricated with the oil housed in the oil pan 51. In addition, the exhaust gases discharged from the engine flow to an exhaust passage 23, which will be described below, through the exhaust pipe 53 and the expansion chamber 54, and is discharged in the water. In the front chamber 2*i* that houses therein the transmission 26 as a precision machine and other suitable elements, and also in the rear chamber 2*j* that houses therein the exhaust pipe 53 through which the hot exhaust gases pass and the exhaust expansion chamber 54, the dividers 2*g*, 2*h* of the upper casing 2 preferably have a structure made with a material and a thickness to prevent any influences of the rear chamber 2*j*, which can reach a high temperature, from affecting the front chamber 2*i*.

As shown in FIG. 1, the vertical drive shaft 18 is pivotally supported in the front chamber 2*i* of the upper casing 2. The upper end of the drive shaft 18 is coupled to the lower end of the crankshaft 6 of the engine 5 preferably by spline-fitting, for example. The drive shaft 18 extends downward through the upper casing 2, reaches the inside of the lower casing 3, and links to a propeller shaft 20 pivotally supported in the lower casing 3 in a horizontal manner via a bevel gear mechanism 19.

As shown in FIGS. 1 and 3, the transmission 26 is provided in the front chamber 2*i* of the upper casing 2. The transmission 26 is mounted on the drive shaft 18 and is arranged to house a speed-changing planetary gear mechanism 28 and a forward/reverse switch 29 in a transmission case 27 that defines an outer shell of the transmission 26. In addition, a final deceleration device 30 that utilizes a planetary gear mechanism is provided right under the transmission 26.

As shown in FIG. 1, the propeller shaft 20 is a double-rotary shaft that coaxially combines an outer shaft 20*a* with an inner shaft 20*b*. A drive bevel gear 19*a* of the bevel gear mechanism 19 rotates as a unit with the drive shaft 18, a driven bevel gear 19*b* thereof rotates as a unit with the outer shaft 20*a*, and a driven bevel gear 19*c* thereof rotates as a unit with an inner shaft 20*b*. A first propeller 21*a* is fixed to the outer shaft 20*a*. A second propeller 21*b* is fixed to the inner shaft 20*b*. These elements define a counter-rotating propeller mechanism 22. An exhaust path 23 is provided in the axial portions of the first propeller 21*a* and the second propeller 21*b*.

As shown in FIGS. 1 and 2, a water pump 41 arranged to draw cooling water for the engine 5 is disposed on an outer surface of the upper casing 2, for example, on a right side surface thereof in the traveling direction of the watercraft. An elevation at which the water pump 41 is disposed is above the transmission device 26, and this position is sufficiently higher than the waterline WL (see FIG. 1) in operation of the outboard motor 1.

When the engine 5 is activated, the rotation of the crankshaft 6 is transmitted to the drive shaft 18, and the speed and forward/reverse direction of the rotation of the drive shaft 18 is changed by the transmission 26. Furthermore, the rotation of the drive shaft 18 is decelerated by the final deceleration device 30 and is transmitted to the propeller shaft 20. The outer shaft 20*a* and the first propeller 21*a*, and the inner shaft 20 band the second propeller 21*b* of the propeller shaft 20 rotate in directions opposite to each other, thereby generating a large propulsive force.

As shown in FIGS. 2, 5, and 6, the upper casing 2 preferably includes an upper-side casing 2*a* and a lower-side casing 2*b*, and preferably has a horizontally split construction in which the upper-side casing 2*a* and the lower-side casing 2*b* are engaged with each other on a mating surface 2*c* located generally in a midsection of the upper casing 2 in the vertical direction and are fastened by a plurality of fixing bolts 9, for example. Then, as shown in FIG. 2, the mounting plate 4 is fixed to a top surface of the upper-side casing 2*a* with a plurality of fixing bolts 10 and through bolts 11, for example, and the lower casing 3 is fixed to a bottom surface of the lower-side casing 2*b* preferably with fixing bolts, which are not shown. The through bolts 11 are inserted from below an upper flange of the upper-side casing 2*a*, pass through the mounting plate 4, and are tightened to the engine 5 so as to jointly fasten the three members 2*a*, 4, 5.

As shown in FIG. 5, the upper-side casing 2*a* has the upper-side divider 2*g* that divides the inside of the upper-side casing 2*a* into the front chamber 2*i* and the rear chamber 2*j*. As shown in FIGS. 4 and 5, the lower-side casing 2*b* has a lower-side divider 2*h* that divides the inside of the lower-side casing 2*b* into the front chamber 2*i* and the rear chamber 2*j*. The upper-side divider 2*g* and the lower-side divider 2*h* are configured to be coplanar with and joined to each other in an arrangement in which the upper-side casing 2*a* engages with the lower-side casing 2*b* on the mating surface 2*c*. In this way, the front chamber 2*i* and the rear chamber 2*j* of the upper casing 2 are separated or divided from each other.

As shown in FIGS. 4 and 5, a plurality of upper-side bolt seats for joining, which is not shown, is provided on a mating surface portion 2*f* of the upper-side divider 2*g*. In the lower-side divider 2*h*, a plurality of lower-side bolt seats 2*m* for joining is provided in positions corresponding to the upper-side bolt seats of the upper-side divider 2*g* in the mating surface portion 2*f*. The upper-side bolt seats of the upper-side divider 2*g* are positioned corresponding to the lower-side bolt seats 2*m* of the lower-side divider 2*h*, and bolts are inserted in the seats to join the joined or mating surfaces 2*c* of the dividers 2*g*, 2*h*. In this way, the joined or mating surfaces 2*c* of the upper-side and the lower-side divider 2*g*, 2*h* are further rigidly joined and sealed so as to reliably divide the front chamber 2*i* from the rear chamber 2*j* of the upper casing 2.

As shown in FIGS. 3, 5, and 6, an upper section 2*d* of the upper casing 2, that is, the lateral width of the upper section 2*d* of the upper-side casing 2*a* (the width in the right and left direction of FIGS. 3 and 6) is preferably relatively narrow or thin in accordance with a mating surface of the mounting plate 4, which is to be joined. In addition, a lower section 2*e* of the upper casing 2, that is, the lateral width of the lower section 2*e* of the lower-side casing 2*b* (the width in the right and left direction of FIGS. 3 and 6) is preferably relatively narrow or thin in accordance with a mating surface of the lower casing 3, which is to be joined. As shown in FIG. 4, the mating surface portion 2*f* that holds the mating surface 2*c* of the upper casing 2 therebetween, that is, the lateral widths of the front chamber 2*i* in a portion lower than the upper section 2*d* of the upper-side casing 2*a* and in a portion higher than the lower section 2*e* of the lower-side casing 2*b* (lateral widths in FIGS. 3 and 6) are preferably wider than the upper section 2*d* and the lower section 2*e* in accordance with the size and configuration of the transmission 26, which is disposed in the front chamber 2*i*.

As described above, the upper casing 2 preferably includes the upper-side casing 2*a* and the lower-side casing 2*b*, with the mating surface 2*c* being located therebetween. Therefore, during assembly of the outboard motor 1, the transmission 26 can be inserted from the mating surface 2*c* and disposed in the front chamber 2*i* of the upper casing 2.

Especially as in this preferred embodiment, when a lateral width of the transmission 26 to be disposed is larger than the lateral width of the joined or mating surface between the mounting plate 4 and the upper section 2*d* of the upper casing 2 and also larger than the lateral width of the joined or mating surface between the lower casing 3 and the lower section 2*e* of the upper casing 2, the transmission 26 cannot be inserted in an upper casing of a conventional single unit type. Consequently, at least either one of the upper section or the lower section of the upper casing has to be configured larger in the lateral width so that the transmission 26 can be inserted in the upper casing. In addition, the mounting plate or the lower case that joins to the upper section or the lower section of the upper case must be remade or specifically made to fit the upper casing, which causes increased costs for assembly of the outboard motor having the transmission.

On the contrary, in the outboard motor 1 of the present preferred embodiment of the present invention, the upper casing 2 includes the upper-side casing 2*a* and the lower-side casing 2*b*, which hold the mating surface 2*c* therebetween. Therefore, even when the lateral widths of the upper section 2*d* and the lower section 2*e* of the upper casing are narrow, the transmission 26 can be inserted from the mating surface 2*c* in the widely-configured mating surface portion 2*f*. Accordingly, the transmission 26 can be inserted in the upper casing 2 without any modification to the joined or mating surface of the upper section 2*d* with the lower section 2*e*.

For the above reason, with regard to the assembly of the outboard motor 1 having the transmission 26, as long as the upper casing 2 is configured such that the upper section 2*d* and the lower section 2*e* are respectively formed to fit the mounting plate 4 and the lower casing 3 of the current condition and that the mating surface portion 2*f* is formed to fit the transmission 26 to be disposed therein, the assembly can be performed without making any modifications to the other components. As a result, it is possible to decrease and minimize the cost for the assembly of the outboard motor 1. In addition, since there is no need to extend the lateral width from the lower section 2*e* of the upper casing 2 through the lower casing 3, it is possible to prevent an increase in resistance to water.

As shown in FIGS. 1 and 5, in this preferred embodiment, a steering bracket 39 is fixedly coupled to a front section of the outboard motor 1 via a right and left pair of upper mounts 33, which is installed in the mounting plate 4 and arranged to hold the drive shaft 18 therebetween, and via a right and left pair of lower mounts provided on right and left side surfaces of the lower-side casing 2*b* of the upper casing 2. The steering bracket 39 is coupled to a swivel bracket 36 by a vertical steering shaft 35, which is shown in FIG. 1. The swivel bracket 36 is coupled to a clamp bracket 38 via a horizontal tilt shaft 37 and a lock mechanism, which is not shown. The clamp bracket 38 is fixed to a transom of the hull S.

The outboard motor 1 can steer the hull S by pivoting to the right and the left about the steering shaft 35, and can also be tilted up above the water surface by pivoting vertically about the tilt shaft 37.

The right and left pair of upper mounts 33 and the right and left pair of lower mounts 34 in this preferred embodiment support the weight of the outboard motor 1, and increase a spring constant by increasing the hardness of elastic members such as rubber disposed in the upper mounts 33 and the lower mounts 34 so that the propulsive force obtained by the outboard motor 1 can easily be transmitted to the hull S.

However, when the spring constants of the upper mounts 33 and the lower mounts 34 are increased, it becomes difficult for the mounts to absorb rotational vibration of the outboard motor 1, thus causing a decline in riding comfort of the watercraft. In order to solve the above problem, the right and left pairs of upper mounts 33 in the present preferred embodiment are disposed with a short distance therebetween, thereby absorbing the rotational vibration by lowering the spring constant in a rotational direction.

More specifically, the right and left pair of upper mounts 33 is arranged such that the lateral width thereof (a distance between outer ends of the two upper mounts 33) becomes narrower than the lateral width of the mating surface portion 2*f* of the upper casing 2 from which the transmission 26 is disposed. The above constitution cannot be achieved in the upper casing of a single unit type to which the transmission is inserted from above, and can only be achieved with the outboard motor 1 according to preferred embodiments of the present invention adopting the constitution in which the transmission 26 is inserted from the mating surface 2*c* of the upper-side casing 2*a* with the lower-side casing 2*b*.

As described so far, according to the outboard motor 1 of this preferred embodiment, the upper casing 2 is preferably defined by the upper-side casing 2*a* and the lower-side casing 2*b*. The mating surface portion 2*f* between the upper-side casing 2*a* and the lower-side casing 2*b* is larger in the lateral width than the upper section 2*d* and the lower section 2*e* of the upper casing 2. Therefore, the transmission 26 can be inserted from the mating surface 2*c* between the upper-side casing 2*a* and the lower-side casing 2*b* and disposed in the front chamber 2*i* of the upper casing 2. In the upper casing 2, while the configurations of the portions joined to other members such as the mounting plate 4 and the lower casing 3 remain the same, only the configuration of a portion in which the transmission 26 is disposed is modified in accordance with the configuration of the wide transmission 26. Therefore, various types of transmissions 26 can be installed in the outboard motor 1 without replacing the mounting plate 4, the lower casing 3, and other members from the conventional ones, but by replacing only the upper casing 2. Consequently, it is possible to decrease and minimize the installation cost of the transmission 26 in the outboard motor 1. In addition, since many of the components that have been used thus far can also be used for the assembly of the outboard motor 1 having the transmission 26, the assembling efficiency of the outboard motor 1 can be improved. Furthermore, since there is no need to extend the lateral width from the lower section 2*e* of the upper casing 2 through the lower casing 3, it is possible to prevent the increased resistance to water.

According to the outboard motor 1 of the above-described preferred embodiment, a distance between the upper mounts 33, which are provided as the right and left pair to support the outboard motor 1 to the hull S, is preferably narrower than the lateral width of the mating surface portion 2*f* in the upper casing 2. Therefore, the upper mounts 33 can prevent and damp the vibrations of the hull S by absorbing the rotational vibrations of the outboard motor 1.

According to the outboard motor 1 of the above-described preferred embodiment, the dividers 2*g*, 2*h* are arranged such that the upper-side divider 2*g* and the lower-side divider 2*h* are joined to each other to divide the inside of the upper casing 2 into the front chamber 2*i* and the rear chamber 2*j*. The transmission 26 is disposed in the front chamber 2*i*. Thus, the transmission 26 can easily be located in a desired position in the upper casing 2 and can be prevented from being influenced or affected by the components disposed in the rear chamber 2*j* (heat, oil content, and moisture, for example).

According to the outboard motor 1 of the above-described preferred embodiment, the upper-side bolt seat and the lower-side bolt seat 2*m* for joining are provided in the mating surface portions 2*f* of the dividers 2*g*, 2*h*. The mating or joined surfaces 2*c* of the dividers 2*g*, 2*h* are sealed. Thus, it is possible to reliably separate the front chamber 2*i* in which the transmission 26 is disposed from the rear chamber 2*j* in which the exhaust pipe and the like are disposed by bolting the mating or joined surfaces 2*c* of the dividers 2*g*, 2*h* to further rigidly join the upper-side and lower-side dividers 2*g*, 2*h*. Consequently, any influences of the components disposed in the rear chamber 2*j* to the transmission 26 (heat, oil content, and moisture, for example) can further be prevented.

The present invention is not limited to the preferred embodiments described above, and various modifications can be made without departing from the spirit and the technical scope thereof.

For example, the transmission 26 disposed in the upper casing 2 is not limited to one described in the above preferred embodiment. For example, a transmission having a large width or a different configuration may be disposed. In such a case, the upper casing 2 may have a mating surface portion 2*f* that is wider in the lateral width or in a configuration to fit the transmission 26.

In this preferred embodiment, the position of the mating surface 2*c* between the upper-side casing 2*a* and the lower-side casing 2*b* in the vertical direction preferably is generally in the midsection of the upper casing 2 in the vertical direction. However, the position of the mating surface C is not limited to the above-described preferred embodiments. For example, as long as the transmission 26 can be inserted and disposed, a position deviated upward in the upper casing 2 may be set as the mating surface 2*c*, or a position deviated downward in the upper casing 2 may be set as the mating surface 2*c*.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. An outboard motor comprising:

an upper casing;

a lower casing located below the upper casing; and an engine including a vertically arranged crankshaft, the engine being mounted above the upper casing; wherein rotation of the crankshaft is transmitted to a drive shaft, a rotational speed of the crankshaft is changed by a transmission mounted on the drive shaft, and a rotational force generated by the crankshaft is transmitted to a propeller shaft pivotally supported in the lower casing;

the upper casing includes an upper side casing and a lower side casing;

a mating surface portion between the upper side casing and the lower side casing is laterally wider than an upper section and a lower section of the upper casing;

a divider is arranged to divide an inside of the upper casing into a front chamber and a rear chamber, and the divider is defined by a divider of the upper side casing and a divider of the lower side casing joined together; and a bolt seat arranged to join the divider of the upper side casing and the divider of the lower side casing is provided in the mating surface portion, and a joined surface of the divider is sealed.

2. The outboard motor according to claim 1, wherein an upper mount and a lower mount are arranged to support the outboard motor on a hull, the upper mount includes a right upper mount and a left upper mount, and a width between the right upper mount and the left upper mount is narrower than a lateral width of the mating surface portion in the upper casing.

3. The outboard motor according to claim 1, wherein the transmission is located in the front chamber.

4. The outboard motor according to claim 1, wherein the rear chamber includes an exhaust pipe arranged to exhaust gases discharged from the engine, and an exhaust expansion chamber arranged to expand the exhaust gases passed through the exhaust pipe.

5. The outboard motor according to claim 1, wherein a lateral width of the transmission is larger than a lateral width of the upper section of the upper casing and a lateral width of the lower section of the upper casing.

6. The outboard motor according to claim 1, wherein the transmission includes a speed-changing planetary gear mechanism and a forward/reverse mechanism.

7. The outboard motor according to claim 1, wherein an internal dimension of the upper side casing and the lower side casing is laterally wider at the mating surface portion than an internal dimension of the upper section of the upper casing and an internal section of the lower section of the upper casing.

8. The outboard motor according to claim 1, wherein a lateral width of the mating surface portion extends in the left and right directions as seen from a front of the outboard motor.

9. The outboard motor according to claim 1, wherein a transmission case defining an outer shell of the transmission extends from the upper side casing into the lower side casing.

* * * * *